US005802619A

United States Patent [19]

Ralston et al.

[11] Patent Number: 5,802,619

[45] Date of Patent: Sep. 8, 1998

[54] CHEERLEADING SKIRT WITH IMPROVED WAISTBAND

[75] Inventors: Sherise M. Ralston; Michele M. Wolken, both of Dallas County, Tex.

[73] Assignee: National Spirit Group, Ltd., Garland, Tex.

[21] Appl. No.: 898,614

[22] Filed: Jul. 22, 1997

[51] Int. Cl.[6] ..... A41D 1/14

[52] U.S. Cl. ..... 2/220; 2/221; 2/237

[58] Field of Search ..... 2/220, 219, 211, 2/221, 236, 237, 210

[56] References Cited

U.S. PATENT DOCUMENTS

| | | | |
|---|---|---|---|
| 1,280,509 | 10/1918 | McNeil | 2/221 |
| 2,109,280 | 2/1938 | Bach | 2/237 |
| 2,526,813 | 10/1950 | Fanning | 2/237 |
| 2,583,992 | 1/1952 | Bouteloup | 2/237 |
| 2,599,983 | 6/1952 | Fanning | 2/237 |
| 3,013,277 | 12/1961 | Satin | 2/221 |
| 3,148,377 | 9/1964 | Anderson | 2/221 |
| 3,292,184 | 12/1966 | Anderson | 2/221 |
| 3,505,685 | 4/1970 | Granchelli | 2/221 |
| 3,793,645 | 2/1974 | Kadison | 2/221 |
| 4,620,326 | 11/1986 | Matthias, Jr. | 2/221 |

*Primary Examiner*—Gloria M. Hale
*Attorney, Agent, or Firm*—Locke Purnell Rain Harrell

[57] ABSTRACT

A skirt suitable for cheerleading is described which is formed by a body and a waistband. The body forms the main section of the skirt and attached along its top edge to the waistband which fits snugly to the wearer's waist, yet still allows for extreme athletic movements. The waistband is formed by an elastic band attached at its ends to two fabric ends which are connected to each other by a closure mechanism such as a button. The elastic band is protected and concealed by a cover material which forms a passageway through which the elastic band passes. The fabric ends and the cover material are attached to the top edge of the body of the skirt to act as the waistband. The elastic band is not permanently attached to the body or the cover material to allow it to stretch freely in response to movements by the wearer. The body of the skirt includes another closure mechanism such as a zipper which works in conjunction with the button on the fabric ends to allow the skirt to be easily put on and taken off. This arrangement provides an attractive, tailored appearance while still allowing all necessary freedom of movement.

15 Claims, 3 Drawing Sheets

CHEERLEADING SKIRT WITH IMPROVED WAISTBAND

BACKGROUND OF THE INVENTION

Cheerleading has been an established and cherished tradition at sporting events for many years. With this tradition has come recognizable uniforms for both male and female cheerleaders. Female cheerleaders traditionally wear short pleated skirts in their team or school colors. Today's cheerleaders are expected not only to lead and organize cheers, but also to entertain as gymnasts, dancers and well trained athletes. As the demands on cheerleaders have grown, so has the need for uniforms which facilitate the necessary range of movements required. In addition, there are many sport in which apparel is needed which would allow maximum range of movement while still comfortable and attractive.

Further, many of the younger athletes are responsible for supplying their own uniforms, and investments in athletic and cheerleading apparel can become quite expensive. A skirt or other article of clothing that would allow for growth and still retain a tailored look and feel would allow younger participants to get the longest benefit from their uniforms.

It would be advantageous to have a skirt for cheerleading or other activities which provided an attractive tailored appearance yet still allow for freedom of movement particularly around the waist.

SUMMARY OF THE INVENTION

In accordance with the present invention, an improved waistband for use with articles of clothing is provided which is formed by a first and second fabric ends attached to an elastic band. The elastic band is protected and concealed by a cover material. The fabric ends and the long edges of the cover material are attached to the body of the article of clothing to form a waistband which provides a tailored appearance while providing for enhanced freedom of movement for the wearer. The elastic band passes through the cover material, but is not attached or sewn to the cover material or the body itself. This allows the elastic band to move freely inside the cover material. The cover material may be attached to the fabric ends, or may be left unattached to allow the fabric ends to move relative to the cover material.

In the preferred embodiment, the article of clothing is a cheerleading skirt. The skirt is formed by a body which is attached to the improved waistband. The body of the cheerleading skirt may be pleated for appearance and includes a closure mechanism, which can be a zipper, adjacent to and perpendicular to the top edge of the body of the skirt. The zipper is also adjacent to the fabric ends of the waistband. The fabric ends of the waistband include another closure mechanism, preferably a button/buttonhole arrangement, which allows the fabric ends to be joined together or detached from one another. The closure mechanism on the fabric ends works in conjunction with the closure mechanism on the body of the skirt to allow the skirt to be put on and taken off with ease while still providing an attractive appearance.

The features and advantages of the invention will become more readily understood from the following detailed description taken in conjunction with the appended claims and attached drawing wherein:

DESCRIPTION OF THE PREFERRED EMBODIMENTS

Figure 1:
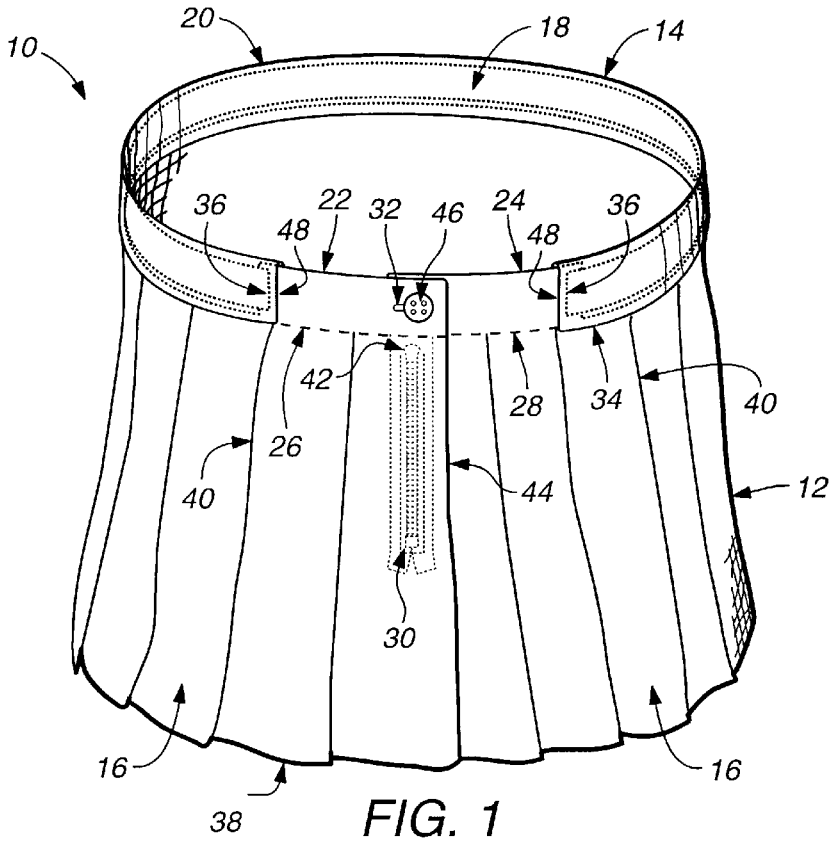
FIG. 1 is a rear perspective view of the cheerleading skirt incorporating the present invention.
Figure 2:
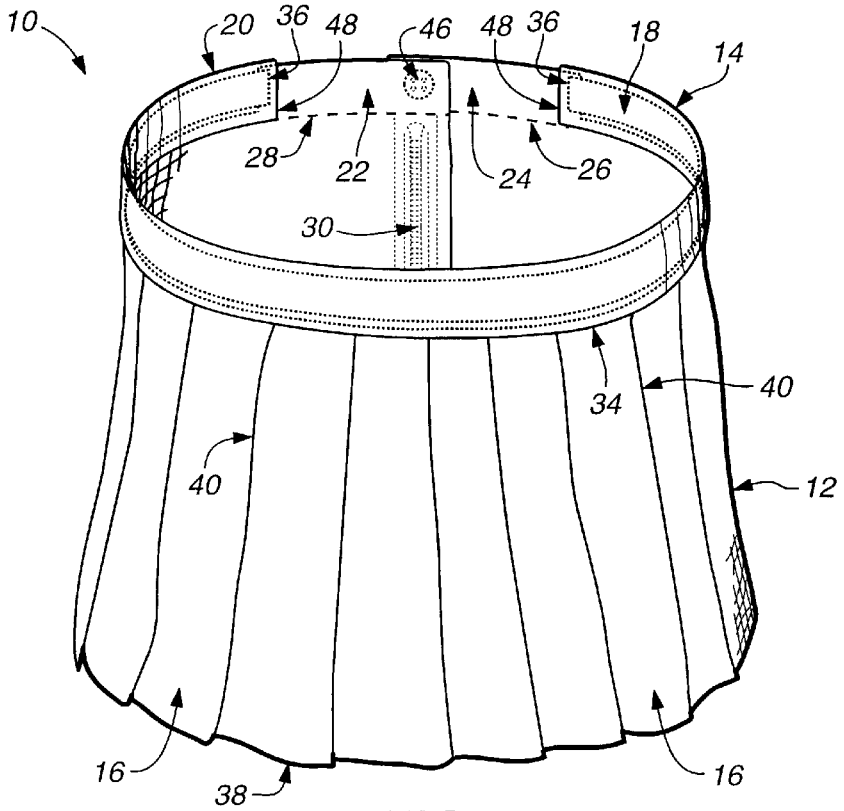
FIG. 2 is a front perspective view of the cheerleading skirt of FIG. 1.

Referring now to FIGS. 1 and 2, the preferred embodiment of the cheerleading skirt incorporating the improved waistband is shown. Skirt 10 is adapted for use by cheerleaders and other athletes needing apparel which allows for enhanced freedom of movement while still providing for a tailored appearance, which could include, but is not limited to sports such as cheerleading or field hockey. Skirt 10 is formed by body 12 and waistband 14. Body 12 is preferably formed by one or more pieces of fabric which can be sewn along pleat seams 40 to form a plurality of pleats 16. Body 12 also includes hem end 38 opposite waistband 14. Zipper 30 is incorporated into body 12 along zipper opening 42. Overlap 44 covers zipper 30 to provide a smooth external appearance to body 12. Body 12 can be formed in any desired color scheme and decorated or embroidered as desired to correspond to a particular team or school.

Waistband 14 is designed to allow for enhanced freedom of movement, and growth room for younger cheerleaders without sacrificing the desired tailored appearance. Waistband 14 includes fabric ends 22 and 24 which are preferably formed from the same material as body 12 and attached to body 12 along seams 26 and 28, respectively. Fabric end 22 includes buttonhole 32, and fabric end 24 has button 46 attached at a location on fabric end corresponding to buttonhole 32. Fabric end 22 and fabric end 24 can be joined using button 46 and buttonhole 32 in conjunction with zipper 30 which closes zipper opening 42 in body 12. The use of button 46 and zipper 30 allow for skirt 10 to have a tailored appearance when worn.

Waistband 14 also includes elastic band 18 which extends from fabric end 22 to fabric end 24 to complete waistband 14. Elastic band 18 is attached to fabric end 22 and fabric end 24 along elastic band attachment seams 36. Cover material 20 conceals elastic band 18. Cover material 20 is attached to body 12 along seam 34, and can either be attached to fabric ends 22 and 24 at terminal ends 48, or can be open at terminal ends 48, allowing the portions of fabric ends 22 and 24 under cover material 20 to move freely. Elastic band 18 does not attach to body 12 or cover material 20 allowing it to stretch freely along its length when tensioned by the pulling of either or both fabric ends 22 and 24.

Figure 3:
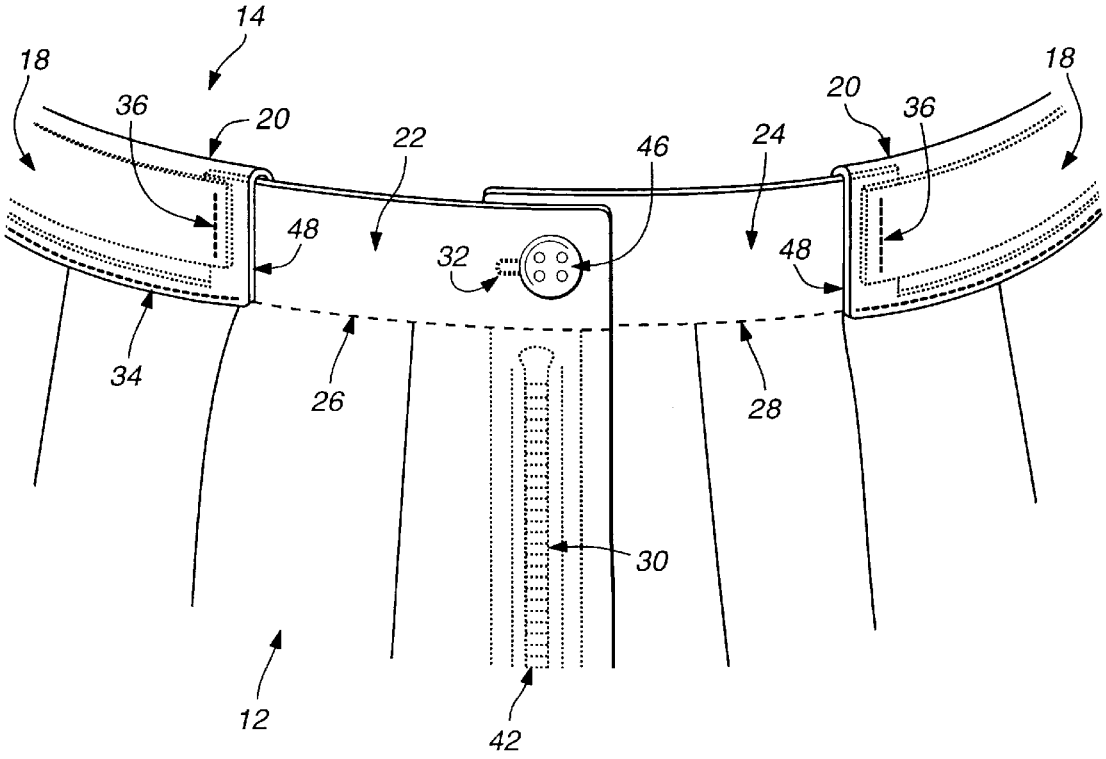
FIG. 3 is an expanded view of the waistband of the cheerleading skirt of FIG. 1.

Referring now to FIG. 3, an expanded view of the rear portion of waistband 14 is shown. Again, body 12 includes zipper opening 42 into which is sewn zipper 30. Zipper opening 42 and zipper 30 allow the upper end of body 12 to be opened for ease in dressing and undressing. Waistband 14 is attached to body 12 along seams 26, 28 and 34. Waistband 14 is essentially formed by fabric ends 22 and 24, elastic band 18 and cover material 20. Fabric ends 22 and 24 attach to body 12 on either side of zipper opening 42. Fabric end 22 includes buttonhole 32, while button 46 is attached to fabric end 24. Button 46 and buttonhole 32 allow fabric ends 22 and 24 to be used in conjunction with zipper opening 42 and zipper 30, where fabric ends 22 and 24 can be joined together or detached from each other using button 42. While the zipper and button arrangement are preferred, and combination of closure mechanisms can be used in body 12 and with fabric ends 22 and 24 to achieve the same function. Such other closure mechanisms can include, but are not limited to, multiple buttons, hook and loop fabric, snaps, individual hooks and loops, laces, and the like.

Waistband 14 is designed to provide for comfort and enhanced mobility while allowing the skirt or other article of clothing to maintain a tailored appearance. This is accomplished by using fabric ends 22 and 24, which are attached to body 12 at seams 26 and 28, respectively, in conjunction with elastic band 18. Elastic band 18 provides waistband 14 with the ability to stretch and move with the wearer. As shown in FIG. 3, elastic band 18 is attached to the ends of fabric ends 22 and 24 opposite buttonhole 32 and button 46, respectively, at elastic band attachment seams 36. Elastic band 18 is not attached to body 12 directly. This arrangement allows elastic band 18 to stretch more fully along its length without being restricted by being sewn directly to body 12.

Elastic band 18 is concealed and protected by cover material 20. Covered material 20 attaches one longitudinal end to the top edge of body 12, folds over elastic band 18, and then attaches again to body 12 along the other longitudinal end. This forms a passage way for elastic band 18 to move freely while still concealed and protected by cover material 20. Cover material 20 extends along the entire length of elastic band 18 and then past the ends of elastic band 18 for at least a short distance. Terminal ends 48 of cover material 20 can either be attached to fabric ends 22 and 24, or can be left open to allow fabric ends 22 and 24 to move slightly in and out of cover material 20 as elastic band 18 stretches.

Figure 4:
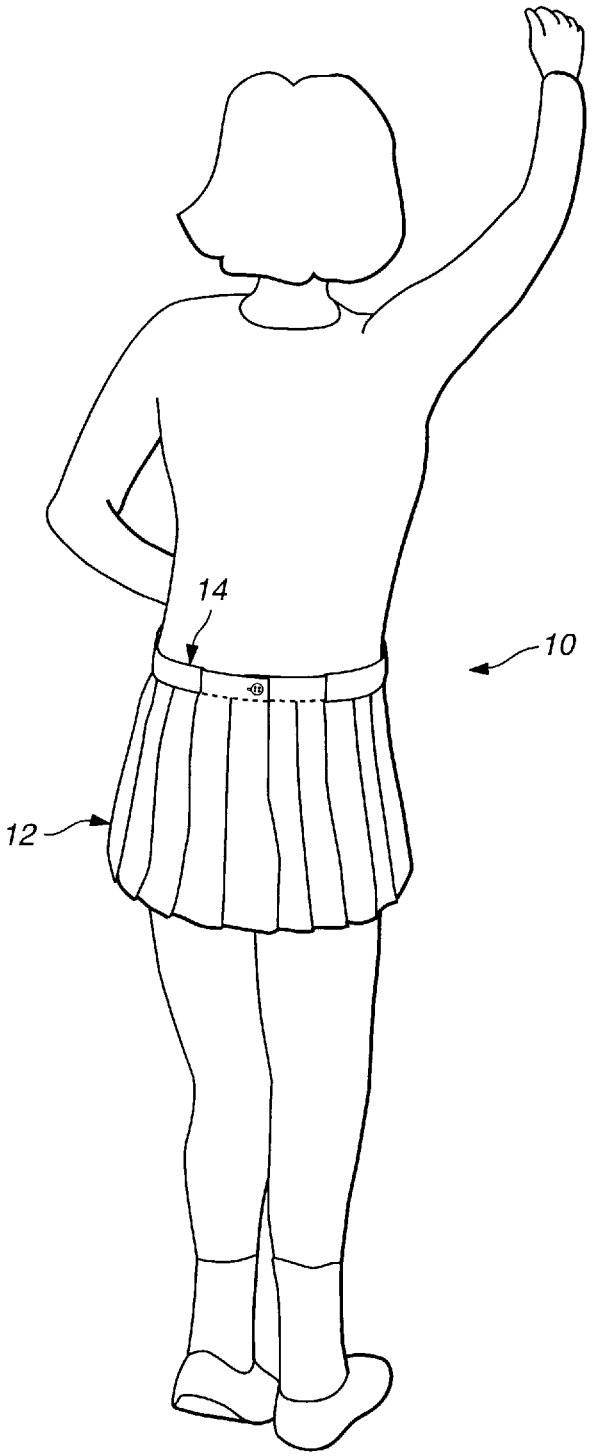
FIG. 4 is a rear view of the cheerleading skirt of FIG. 1 shown being worn by a cheerleader.

FIG. 4 shows skirt 10 being worn by a cheerleader. The assembly of waistband 14 shown in FIGS. 1 through 3 allow it to fit snugly around the cheerleaders waist while still allowing the stretch and movement required by the tumbling and dance movements performed. In addition to the enhanced freedom of movement, waistband 14 also allows body 12 to fit properly and to provide the tailored appearance desired for cheerleading.

It is to be understood that although the invention has been described with particular reference to specific embodiments thereof, the form of the invention shown and described in detail is to be taken as the preferred embodiment of same, and that various changes and modifications may be resorted to without departing from the spirit and scope of the invention as defined by the appended claims.

What is claimed:

1. A article of clothing suitable for cheerleading and other athletic activities comprising:

a) a body which includes a first closure mechanism; and b) a waistband connected to the body, the waistband further comprising:

a first fabric end;

a second fabric end, wherein the first and second fabric ends include a second closure mechanism and the first and second fabric ends are connected to the body adjacent to the first closure mechanism;

an elastic band connected to the first and second fabric end such that the first fabric end, the elastic band, and the second fabric end form the radius of the waistband; and a cover material concealing the elastic band and connected to the body such that the entire waistband is attached to the body by the cover material and the first and second fabric ends.

2. The article of clothing of claim 1 wherein the first closure mechanism is a zipper.

3. The article of clothing of claim 1 wherein the second closure mechanism is a button such that the first fabric end includes a buttonhole, and the second fabric end includes the button.

4. The article of clothing of claim 1 where in the body forms a cheerleading skirt.

5. The article of clothing of claim 1 wherein the cover material is attached to the first and second fabric ends.

6. A cheerleading skirt with and waistband comprising:

a) a body formed into a skirt, the body having a top edge and an inside and an outside; and b) a waistband attached to the top edge of the body, the waistband fitting around the wearer's waist and further comprising:

a first fabric end having a buttonhole at a first end and being attached to the top edge of the body along a bottom edge;

a second fabric end having a button at a first end adapted to fit the buttonhole, the second fabric end attached to the top edge of the body along a bottom edge;

an elastic band having a first and second terminal ends, the first terminal end connected to a second end of the first fabric end opposite the buttonhole, and the second terminal end connected to a second end of the second fabric end opposite the button; and a cover material having a first long edge and second long edge, the first long edge attached to the outside of the body along the top edge, and the second long edge attached to the inside of the body along the top edge thereby forming a passage through which the elastic band passes.

7. The cheerleading skirt of claim 6 wherein the body includes a zipper adjacent to the first and second fabric ends, the zipper working in conjunction with the button to allow the wearer to put on and take of the cheerleading skirt.

8. The cheerleading skirt of claim 6 wherein the cover material includes a first short end and a second short end, the first short end attached to the first fabric end and the second short end attached to the second fabric end.

9. The cheerleading skirt of claim 6 wherein the first fabric end, the second fabric end and the cover material are attached to the body by sewing.

10. The cheerleading skirt of claim 6 wherein the body is formed into a plurality of pleats.

11. A waistband for an article of clothing, the article of clothing having a body with a top edge to which the waistband is attached, the waistband fitting around a wearer's waist and comprising:

a first fabric end having a buttonhole at a first end and being attached to the top edge of the body along a bottom edge;

a second fabric end having a button at a first end adapted to fit the buttonhole, the second fabric end attached to the top edge of the body along a bottom edge;

an elastic band having a first and second terminal ends, the first terminal end connected to a second end of the first fabric end opposite the buttonhole, and the second terminal end connected to a second end of the second fabric end opposite the button; and a cover material having a first long edge and second long edge, the first long edge attached to the outside of the body along the top edge, and the second long edge attached to the inside of the body along the top edge thereby forming a passage through which the elastic band passes.

12. The waistband of claim 11 wherein the cover material includes a first short end and a second short end, the first short end attached to the first fabric end and the second short end attached to the second fabric end.

13. The waistband of claim 11 wherein the first fabric end, the second fabric end and the cover material are attached to the body by sewing.

14. The waistband of claim 11 wherein the body includes a zipper adjacent to the first and second fabric ends, the zipper working in conjunction with the button to allow the wearer to put on and take of the cheerleading skirt.

15. The article of clothing of claim 11 where in the body forms a cheerleading skirt.

* * * * *